US009919541B2

(12) United States Patent
Tamaki et al.

(10) Patent No.: US 9,919,541 B2
(45) Date of Patent: Mar. 20, 2018

(54) LIQUID DISCHARGE APPARATUS AND METHOD OF PRESSING MEDIUM

(71) Applicant: Seiko Epson Corporation, Tokyo (JP)

(72) Inventors: Takayuki Tamaki, Shiojiri (JP); Hideyuki Kataoka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/253,452

(22) Filed: Aug. 31, 2016

(65) Prior Publication Data

US 2017/0066259 A1 Mar. 9, 2017

(30) Foreign Application Priority Data

Sep. 7, 2015 (JP) ..... 2015-176006

(51) Int. Cl.
*B41J 11/00* (2006.01)
*B41J 13/10* (2006.01)

(52) U.S. Cl.
CPC ..... *B41J 11/005* (2013.01); *B41J 11/0005* (2013.01); *B41J 13/106* (2013.01); *B41J 11/0085* (2013.01)

(58) Field of Classification Search
CPC ..... B41J 11/0005; B41J 13/106
See application file for complete search history.

(56) References Cited

U.S. PATENT DOCUMENTS

2003/0048345 A1* 3/2003 Matsumoto ..... B41J 11/005 347/104
2003/0057635 A1* 3/2003 Fukushima ..... B65H 1/022 271/126
2005/0225594 A1* 10/2005 Isono ..... B41J 13/14 347/37

FOREIGN PATENT DOCUMENTS

JP 05-046448 U 6/1993
JP 2004-160844 A 6/2004
JP 2011-167888 A 9/2011

* cited by examiner

*Primary Examiner* — Bradley Thies
(74) *Attorney, Agent, or Firm* — Workman Nydegger

(57) ABSTRACT

A liquid discharge apparatus (printing device) includes a support section that supports a medium, a discharge section that discharges a liquid onto the medium that is supported by the support section, a holding section (carriage) that holds the discharge section, and a pressing section (rollers) that can change the position to a first position for pressing the medium against the support section or to a second position for releasing the medium. The pressing section is placed within an area between the holding section and the support section at the first position, and is placed outside the area between the holding section and the support section at the second position.

8 Claims, 6 Drawing Sheets

LIQUID DISCHARGE APPARATUS AND METHOD OF PRESSING MEDIUM

BACKGROUND

1. Technical Field

The present invention relates to a liquid discharge apparatus such as an ink jet printer and a method of pressing a medium in the liquid discharge apparatus.

2. Related Art

Examples of liquid discharge apparatuses include ink jet printing apparatuses that discharge an ink, which is an example of a liquid, from a discharge section onto a medium such as paper supported by a support section to perform printing. Among them, some printing apparatuses include a transport roller (drive roller) that applies a transport force to a printed medium and a pressing section (driven roller) that presses the medium against the drive roller (for example, see JP-A-2011-167888).

Such printing apparatuses control the force for pressing the medium by moving the pressing section upward and downward to place the pressing section in a contact section where the pressing section is brought in contact with the medium or in a retracted position where the pressing section is retracted from the medium.

Some of the printing apparatuses that include the movable pressing section change the positions of the pressing section depending on the type of medium to be printed. In other words, to perform printing on a medium that tends to rise from a supporting section due to ink discharge, the printing apparatuses place the pressing section in a contact position to reduce rising of the medium, and to perform printing on a medium that rarely rises from the supporting section when the ink is discharged, the printing apparatus retracts the pressing section to a retracted position to reduce unnecessary contact of the medium and the pressing section.

Meanwhile, to effectively reduce rising of the medium on which ink discharge has been performed from the supporting section, it is preferable that the contact position and the discharge section be close to each other to press the medium immediately after the ink discharge. However, if the pressing section is moved to a position too close to the discharge section, when the pressing section is moved upward from the contact position to the retracted position, the pressing section may come into contact with the discharge section and/or a holding section that holds the discharge section.

SUMMARY

An advantage of some aspects of the invention is that there are provided a liquid discharge apparatus and a method of pressing a medium capable of reducing rising of a medium when a pressing section is placed in a position for pressing the medium, and preventing the pressing section from coming into contact with a discharge section and/or a holding section that holds the discharge section when the pressing section is retracted.

Hereinafter, an apparatus for solving the above-mentioned problem and its operational advantages will be described. A liquid discharge apparatus for solving the above-mentioned problem includes a support section that supports a medium, a discharge section configured to discharge a liquid onto the medium that is supported by the support section, a holding section that holds the discharge section, and a pressing section capable of changing its position to a first position for pressing the medium against the support section or to a second position for releasing the medium. The pressing section is placed within an area between the holding section and the support section at the first position, and is placed outside the area between the holding section and the support section at the second position.

With this structure, at the first position, the pressing section is placed within the area between the holding section and the support section, and the pressing section placed in the first position can press the medium on which the liquid has been discharged at the position near the discharge section, whereas at the second position, the pressing section is placed outside the area between the holding section and the support section, and the risk of the pressing section placed in the second position pressing the discharge section and/or the holding section can be reduced.

Consequently, when the pressing section is placed in the first position for pressing the medium, rising of the medium can be reduced, and when the pressing section is retracted in the second position for releasing the medium, the discharge section and the holding section can be prevented from coming into contact with the pressing section.

In the above-described liquid discharge apparatus, it is preferable that the pressing section slide between the first position and the second position. In a case where the structure in which the pressing section moves between the first position and the second position is employed, it is preferable not to provide a member for regulating the movement of the pressing section between the first position and the second position. According to this structure, the pressing section slides between the first position and the second position, and the area in which the pressing section moves can be reduced compared with, for example, a case where the pressing section rotates and moves between the first position and the second position. With this structure, the degree of freedom of arrangement of the other components in areas other than the movement area of the pressing section can be increased.

In the above-described liquid discharge apparatus, it is preferable that the pressing section move from the first position to the second position by moving in a diagonal direction with respect to a direction in which the support section faces the discharge section.

That is, the pressing section moves away from the support section to move from the first position to the second position. In the movement of the pressing section, if the pressing section is moved along the direction in which the support section faces the discharge section, the pressing section moving away from the support section comes close to the discharge section and the holding section, and may come into contact with the discharge section and/or the holding section.

On the other hand, with above-described structure, the pressing section moves in the diagonal direction with respect to the direction in which the support section faces the discharge section to move from the first position to the second position and thereby the pressing section can be prevented from moving toward the discharge section and the holding section while the pressing section is moving away from the support section. Consequently, the pressing section can be appropriately prevented from coming into contact with the discharge section and/or the holding section when the pressing section is in the second position.

In the above-described liquid discharge apparatus, it is preferable that the liquid discharge apparatus include a controller configured to determine whether to place the pressing section in the first position or in the second position depending on the type of medium. With this structure, when the liquid is discharged onto a medium that tends to rise from the support section due to the discharge of the liquid, the pressing section can be placed in the first position to reduce rising. On the other hand, when the liquid is discharged onto a medium that rarely rise from the support section by the discharge of the liquid, the pressing section can be placed in the second position to prevent unnecessary contact between the pressing section and the medium.

In the above-described liquid discharge apparatus, the support section includes a first support section for supporting the medium within a region the discharge section discharges the liquid, and a second support section for supporting the medium outside the discharge region. It is preferable that, in the direction in which the support section faces the discharge section, a space between the second support section and the discharge section be wider than a space between the first support section and the discharge section.

In the above-described structure, if it is defined that the direction in which the support section faces the discharge section is a height direction, the height of the second support section is lower than that of the first support section. Accordingly, in the direction (height direction) the support section faces the discharge section, a portion of the medium that curves outward from the support section side toward the discharge section side drops onto the second support section, and thereby rising of the medium on the support section can be reduced. Consequently, the risk of the medium coming into contact with the discharge section and/or the holding section can be reduced.

In the above-described liquid discharge apparatus, it is preferable that the pressing section press the medium against the second support section at the first position. With this structure, by the pressing section that is placed in the first position, the medium on which the liquid has been discharged can be pressed against the second support section that is provided to have a height lower than that of the first support section. With this structure, rising of the medium from the second support section can be further reduced compared with a case where the second support section has the same height as the first support section, and a case where the second support section has a height higher than that of the first support section. Accordingly, the risk of the medium supported by the second support section coming into contact with the holding section can be further reduced.

In the above-described liquid discharge apparatus, it is preferable that the pressing section be a rotatable roller. If a structure in which the pressing section does not rotate is employed, for example, if the pressing section is a pressing plate having a plate-like shape, the medium may be creased due to the friction between the pressing section and the medium on which the liquid has been discharged. In the above-described structure, however, the pressing section is a rotatable roller, and this causes less friction between the pressing section and the medium, and thereby the occurrence of the above-mentioned problem can be reduced.

In the above-described liquid discharge apparatus, it is preferable that if a cycle in which the medium undulates in a width direction of the medium due to the discharge of the liquid onto the medium is an undulation cycle, a plurality of rollers be aligned in the width direction, and an arrangement interval between the rollers be shorter than the undulation cycle.

For example, if it is assumed that the arrangement interval of the rollers is greater than or equal to the undulation cycle, only the trough portions of the undulating medium may be pressed. The trough portions in undulations are convex portions with respect to the support section, and even if the trough portions are pressed, it is difficult to effectively reduce rising of the medium.

In the above-described structure, however, the arrangement interval of the rollers is less than the undulation cycle, and consequently, the problem that only the trough portions of the undulating medium may be pressed can be prevented. In other words, the crest portions (convex portions with respect to the discharge section) of the undulating medium can be pressed. Accordingly, with this structure, rising of the undulating medium from the support section can be effectively reduced.

A method of pressing a medium in a liquid discharge apparatus for solving the above-mentioned problem is a method of pressing a medium in a liquid discharge apparatus that includes a support section that supports the medium, a discharge section configured to discharge a liquid onto the medium that is supported by the support section, a holding section that holds the discharge section, and a pressing section capable of changing its position to a first position for pressing the medium against the support section or to a second position for releasing the medium. The method includes placing the pressing section in the first position within an area between the holding section and the support section to press the medium, and placing the pressing section in the second position outside the area between the holding section and the support section to release the medium.

According to the method, to press the medium, the pressing section is placed in the first position that is within the area between the holding section and the support section and thereby the medium on which the liquid has been discharged can be pressed at the position near the discharge section. On the other hand, to release the medium, the pressing section is placed in the second position that is outside the area between the holding section and the support section, and thereby the risk of the pressing section that is placed in the second position coming into contact with the discharge section and/or the holding member can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid discharge apparatus according to an embodiment will be described with reference to the attached drawings. The liquid discharge apparatus according to the embodiment is a printing device 10 that performs printing by discharging an ink, which is an example a liquid, onto a medium. The printing device 10 is, specifically, an ink jet printer.

Figure 1:
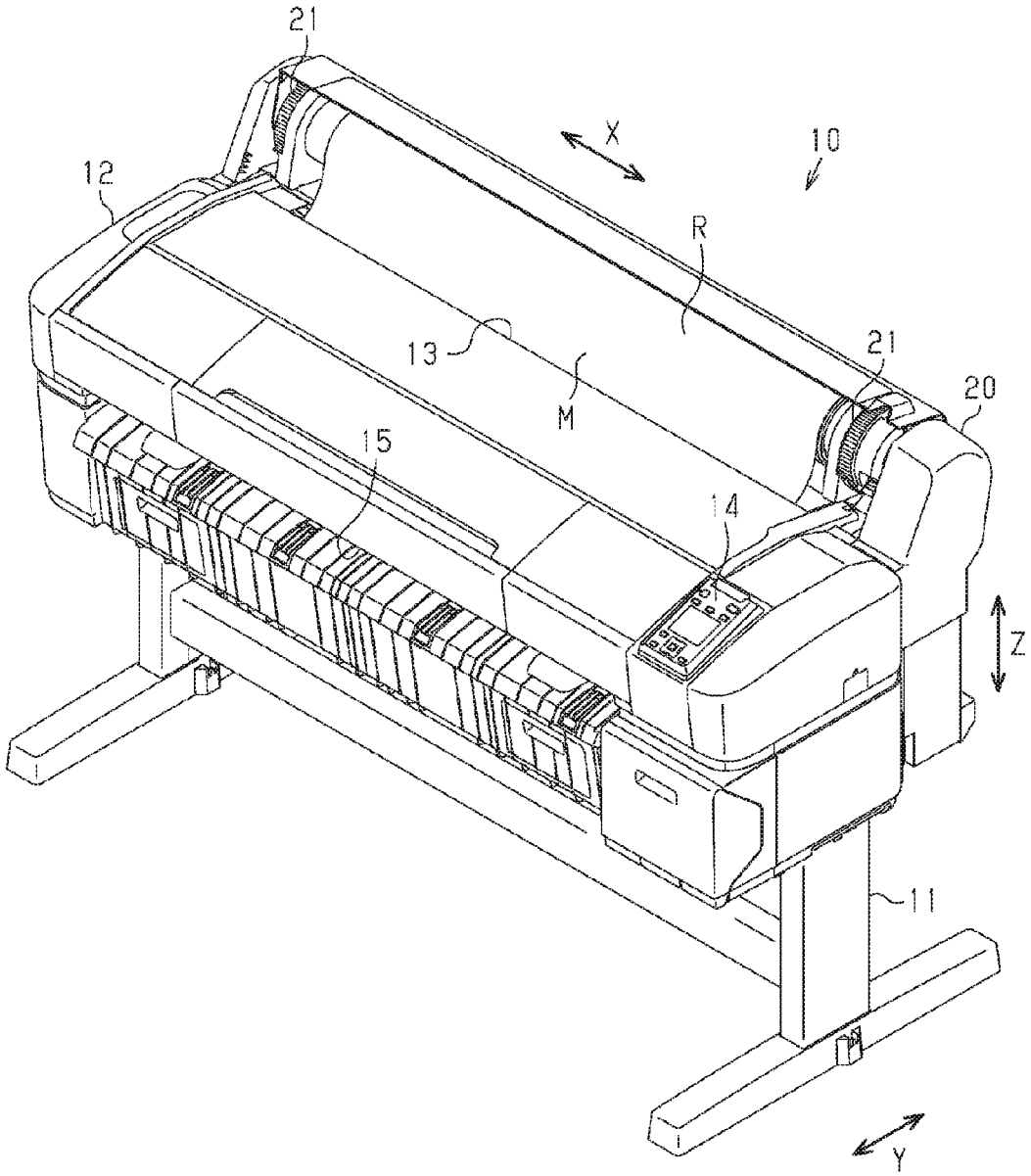
FIG. 1 is a perspective view of a printing apparatus according to an embodiment.

As shown in FIG. 1, the printing device 10 includes a rectangular parallelepiped casing 12 that is supported by a leg stand 11, and a sheet feeding section 20 that protrudes upward from a back surface of the casing 12. The sheet feeding section 20 is provided with holding units 21, which rotatably hold a roll body R of a medium M wound in a cylindrical shape, at both ends of the sheet feeding section 20 in an axis direction of the roll body R.

In the following description, "width direction X" refers to a width direction of the printing device 10, the direction also corresponds to the axis direction of the roll body R, "front-rear direction Y" refers to a front-rear direction of the printing device 10, "up-down direction Z" refers to an up-down direction (vertical direction) of the printing device 10, and "transport direction F" refers to a direction in which the medium M that is unwound from the sheet feeding section 20 is transported. The width direction X, the front-rear direction Y, and the up-down direction Z intersect each other (are orthogonal to each other), and the transport direction F intersects (is orthogonal to) the width direction X. The width direction X also corresponds to a width direction of the medium M.

As shown in FIG. 1, a feed port 13 for feeding the medium M that is fed from the roll body R, which has been loaded in the sheet feeding section 20, into the casing 12 is provided in an upper rear portion of the casing 12. An operation section 14 is provided in an upper portion of the casing 12 and at one end (in FIG. 1, the right end) in the lengthwise direction of the casing 12. The operation section 14 is operated by a user, for example, to set various settings for the printing device 10 and issue a print instruction. A discharge port 15 is provided on the front surface of the casing 12 to discharge the medium M that is fed from the feed port 13 into the casing 12 to the outside of the casing 12.

Figure 2:
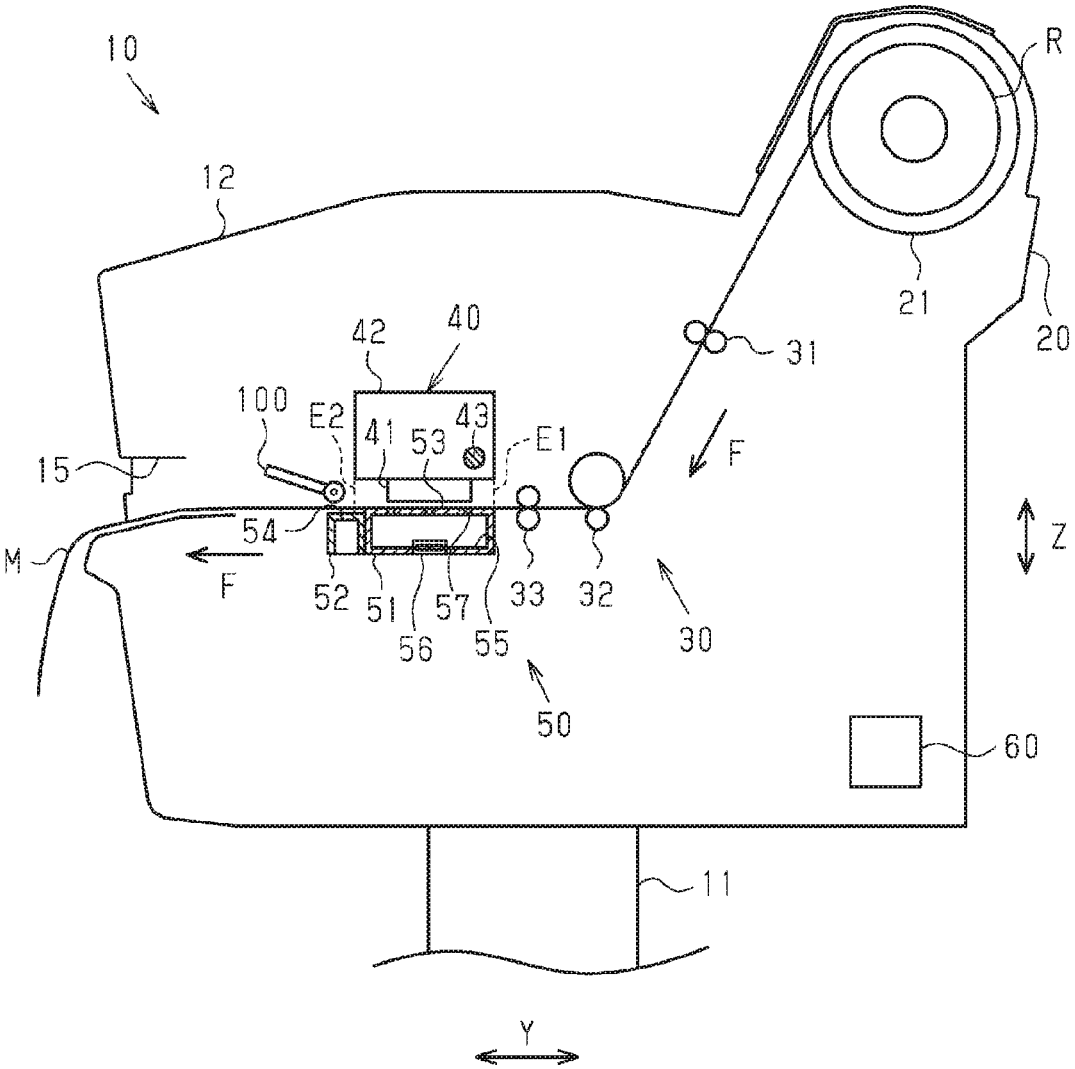
FIG. 2 is a side cross-sectional view showing a schematic structure of the printing apparatus.

As shown in FIG. 2, the printing device 10 includes, in the casing 12, a transport section 30 that transports the medium M, a print section 40 that performs printing on the medium M, a support section 50 that supports the medium M, a pressing mechanism 100 that suppresses rising of the medium M from the support section 50, and a controller 60 that performs overall control of the device.

The transport section 30 includes a plurality of transport rollers 31, 32, and 33 that nip and support the medium M from the front side and the rear side. The transport section 30 drives the transport rollers 31, 32, and 33 to transport the medium M by a predetermined amount in the transport direction F, and stops driving of the transport rollers 31, 32, and 33 to stop the transport of the medium M.

The print section 40 includes a discharge section 41 that discharges an ink, a carriage 42 that holds the discharge section 41 such that the discharge section 41 faces the support section 50, and a support shaft 43 that supports the carriage 42 such that the carriage 42 can reciprocate in the width directions X. The discharge section 41 is, specifically, a head that discharges an ink, which is an example liquid. A nozzle (not shown) that faces the support section 50 and discharges the ink is provided on the discharge section 41. The discharge section 41 discharges the liquid onto the medium M that is supported by the support section 50.

The carriage 42 holds the discharge section 41 in a substantially central portion of a surface (lower surface) that is larger than the discharge section 41 in the width direction X and the front-rear direction Y and that can face the support section 50. An area is defined between the carriage 42 and the support section 50 on the downstream side of the discharge section 41 in the transport direction F. With such features, in this embodiment, the carriage 42 corresponds to an example of a "holding section". The print section 40 discharges the ink from the discharge section 41 onto the medium M while moving the carriage 42 in the width direction X to perform printing of one pass.

The support section 50 includes a first support section 51 that is provided in an area where the first support section 51 can face the discharge section 41 that is held by the carriage 42, and a second support section 52 that is provided in an area where the second support section 52 does not face the discharge section 41 and on the downstream side of the first support section 51 in the transport direction F. In other words, the first support section 51 supports the medium M in the region including the discharge region where the discharge section 41 discharges the ink while moving in the width directions X, and the second support section 52 supports the medium M in the area outside the discharge region. The first support section 51 has a first support surface 53 that can face the carriage 42, and the second support section 52 has a second support surface 54 that can face the carriage 42.

The first support section 51 includes a decompression chamber 55 that has a closed space and a decompression section 56 (for example, a fan) that reduces the pressure in the decompression chamber 55. A plurality of suction holes 57 that communicate with the decompression chamber 55 are provided on the first support surface 53 of the first support section 51. The support section 50 reduces the pressure in the decompression chamber 55 by driving the decompression section 56 to suck the air from the suction holes 57 on the first support surface 53. The first support section 51 sucks the medium M by the suction force applied to the first support surface 53 to stabilize the orientation of the medium M. It is preferable that the suction force applied to the first support surface 53 be a force at a level not affecting the transport of the medium M by the transport section 30.

On the other hand, unlike the first support surface 53 of the first support section 51, no suction holes 57 are provided on the second support surface 54 of the second support section 52. Furthermore, the space between the second support surface 54 and the discharge surface of the discharge section 41 is wider than the space between the first support surface 53 and the discharge surface of the discharge section 41 in the direction (the up-down direction Z) in which the discharge section 41 faces the support section 50.

Accordingly, a step is formed between the first support section 51 and the second support section 52 such that its height decreases in the transport direction F.

In other words, the support section 50 includes the first support section 51 that supports the medium M within the region the discharge section 41 discharges the liquid, and the second support section 52 that supports the medium M outside the discharge region. The space between the second support section 52 and the discharge section 41 is wider than the space between the first support surface 51 and the discharge section 41 in the direction in which the support section 50 faces the discharge section 41. If it is defined that the direction in which the support section 50 faces the discharge section 41 is a height direction, the height of the second support section 52 is lower than that of the first support section 51. With such a structure, in the direction the support section 50 faces the discharge section 41, a portion of the medium M that curves outward from the support section 50 side toward the discharge section 41 side drops onto the second support section 52, and thereby rising of the medium M on the support section 50 can be reduced. Consequently, the risk of the medium M coming into contact with the discharge section 41 and/or the holding section can be reduced.

Figure 3:
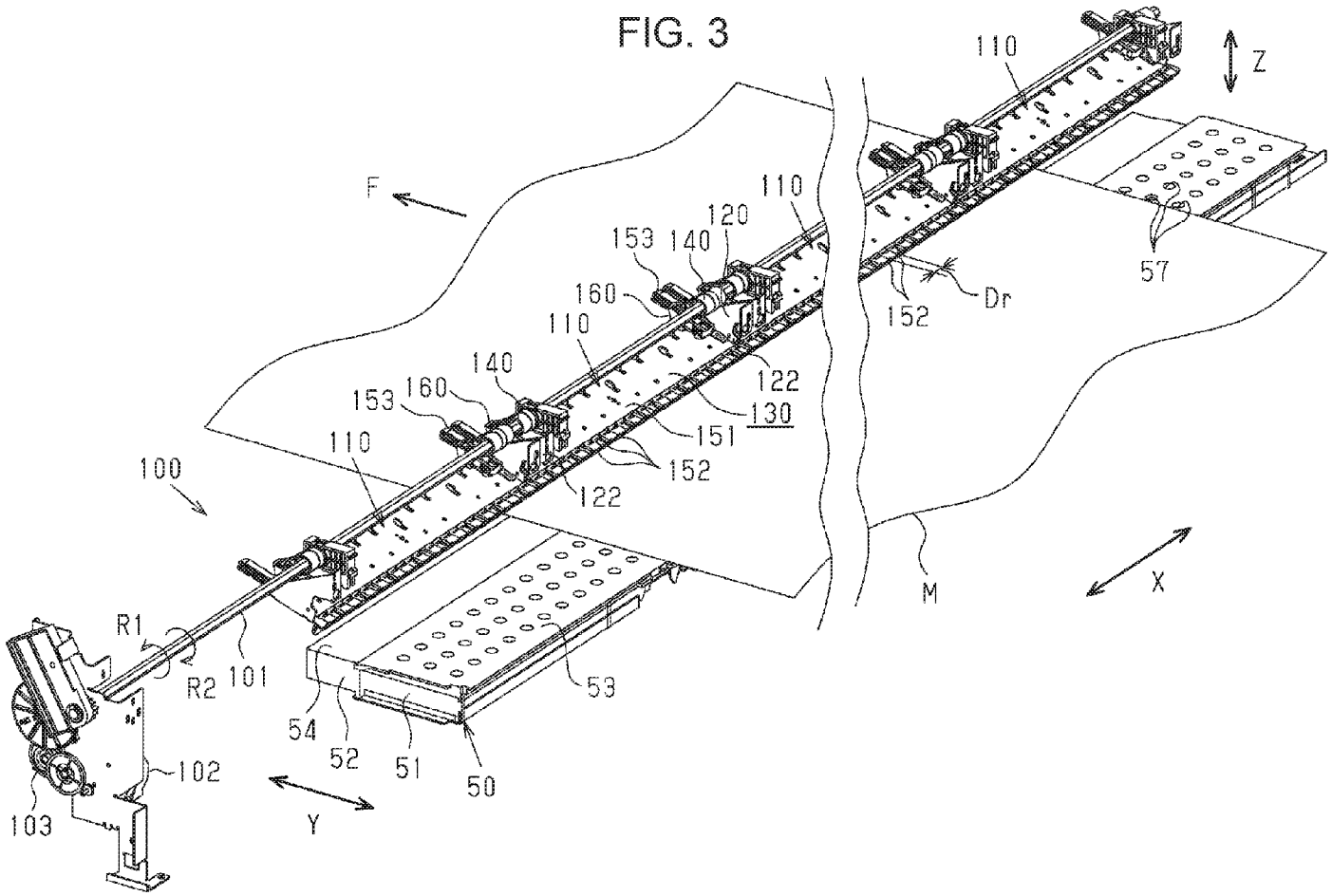
FIG. 3 is a perspective view of a pressing mechanism in which rollers are placed in a second position.

With reference to FIG. 3, the pressing mechanism 100 will be described. As shown in FIG. 3, the pressing mechanism 100 includes a transmission shaft 101 in which the width direction X is a lengthwise direction, a motor 102 that can rotate in the forward and reverse directions, a speed reducer 103 that drive-connects an output shaft of the motor 102 and the transmission shaft 101, and a plurality of pressing units 110 that press the medium M.

As shown in FIG. 3, the motor 102 and the speed reducer 103 are provided at locations closer to one end (the lower left side in FIG. 3) in the width direction X than the support section 50. Furthermore, the speed reducer 103 is connected to one end of the transmission shaft 101 in the width direction X. With this structure, the transmission shaft 101 is rotated in a first rotation direction R1 while the output shaft of the motor 102 is rotating in the forward direction, and is rotated in a second rotation direction R2, which is the reverse direction of the first rotation direction R1, while the output shaft of the motor 102 is rotating in the reverse direction.

Figure 4:
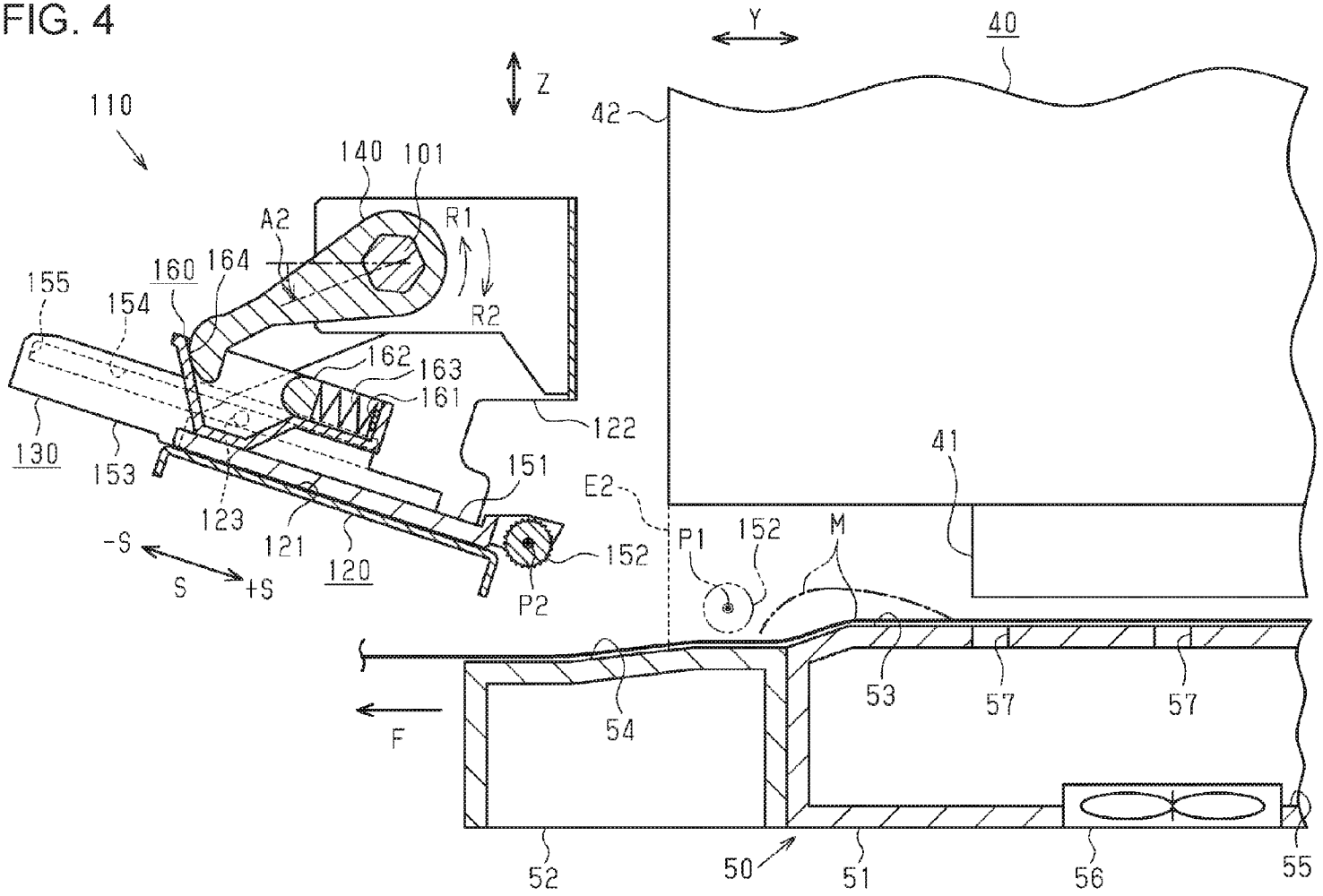
FIG. 4 is a side cross-sectional view of a pressing unit in which the rollers are placed in the second position.

As shown in FIG. 3 and FIG. 4, the pressing unit 110 is disposed downstream of the print section 40 in the transport direction F, and at a position higher than the support section 50 in the vertical direction. Furthermore, the plurality of pressing units 110 are aligned in the width direction X such that the length of the pressing units 110 in the width direction X corresponds to that of the support section 50.

As shown in FIG. 3 and FIG. 4, the pressing unit 110 includes a support frame 120 that has a guide surface 121 that is increasingly separated from the support section 50 on the downstream side in the transport direction F, a moving member 130 that slides along the guiding surface 121 with respect to the support frame 120, and a lever 140 that rotates together with the transmission shaft 101.

As shown in FIG. 3 and FIG. 4, the support frame 120 has bent portions 122 that are bent upward and intersect (are perpendicular to) the guide surface 121 at both end portions in the width direction X. The support frame 120 is fixed to a frame (not shown) of the printing device 10 through the bent portions 122. Each of the bent portions 122 has a convex portion 123 that protrudes in the direction (width direction X) in which the bent portions 122 face each other.

As shown in FIG. 3 and FIG. 4, the moving member 130 includes a slider 151 that is provided on the guide surface 121 of the support frame 120, and rollers 152 that are supported at the tip of the slider 151. The moving member 130 includes rails 153 that are provided at both sides of the slider 151 as a pair in the width direction X, and box bodies 160 that are provided at both sides of the slider 151 as a pair in the width direction X.

In the following description, the directions the moving member 130 moves along the guide surface 121 are also referred to as "slide directions S". In the slide directions S, a slide direction +S refers to a direction in which the moving member moves toward the support section 50 (second support section 52), and a slide direction −S refers to a direction in which the moving member moves away from the support section 50 (second support section 52). The slide directions S refer to directions which intersect (are perpendicular to) the width direction X, and intersect the front-rear direction Y (transport direction F) and the up-down direction Z.

As shown in FIG. 3 and FIG. 4, the slider 151 has a rectangular plate shape in which the width direction X is a long length direction and the slide direction S is a short length direction. The length of the slider 151 in the width direction X is shorter than the length between the bent portions 122 of the support frame 120. With such a structure, the slider 151 is supported between the bent portions 122 of the support frame 120 and on the guide surface 121 of the support frame 120.

As shown in FIG. 3, the plurality of rollers 152 are provided at predetermined arrangement intervals Dr in the width direction X. The arrangement interval Dr is a distance between one end portion of one of the rollers 152 in the width direction X and one end portion of an adjacent one of the rollers 152 in the width direction X.

As shown in FIG. 4, the rollers 152 can be driven and rotated about the rotational axis, which corresponds to the width direction X, while the rollers 152 are in contact with the medium M transported in the transport direction F. The rollers 152 press the transported medium M against the support section 50 to reduce rising of the medium M on the support section 50. With such features, in this embodiment, the rollers 152 correspond to an example of a "pressing section". In other words, in this embodiment, the pressing section corresponds to the rotatable rollers 152.

As shown in FIG. 4, each of the rollers 152 is a star wheel that has a substantially star shape in side view to allow the contact area with respect to the medium M to be small when the rollers 152 are rotated by coming into contact with the transported medium M. Accordingly, it is preferable that the thickness of the rollers 152 in the width direction X be small to reduce the contact area. Although it will be described in detail below, the arrangement interval Dr between the rollers 152 in the width direction X is determined based on the properties of the medium M on which printing is to be performed by the printing device 10.

As shown in FIG. 3 and FIG. 4, each rail 153 has a quadrilateral rod-like shape in which the slide direction S is a long length direction, and is fixed at both sides of the slider 151 in the width direction X. As shown in FIG. 4, a concave slide groove 154 is provided on the rail 153 in the long length direction of the rail 153 and on the surface opposite to the bent portion 122 of the support frame 120. The slide groove 154 engages with the convex portion 123 that protrudes from the bent portion 122 toward the rail 153. With such a structure, the rail 153 slides together with the convex portion 123 via the slide groove 154 and moves in the slide directions S with respect to the support frame 120.

The end surface of the slide groove 154 in the slide direction −S serves as a restriction surface 155 that restricts the movement of the rail 153 with respect to the support frame 120. That is, when the restriction surface 155 of the slide groove 154 comes into contact with the convex portion 123 during the movement of the rail 153 in the slide direction +S, the movement of the rail 153 in the slide direction +S is restricted.

As shown in FIG. 4, the box body 160 has a box shape with a bottom, and the upper part is open. The box body 160 is fixed to the slider 151 with the open top such that the box body 160 is adjacent to the rail 153 in the width direction X. A spring washer 161 is provided on the inner wall of the box body 160 in the slide direction +S.

The box body 160 includes therein a to-be-pressed section 162 disposed to face the tip front side of the lever 140 in the slide direction S, and a coil spring 163 that engages with the to-be-pressed section 162 at one end and engages with the spring washer 161 at the other end. The coil spring 163 can be compressed according to a movement of the to-be-pressed section 162 in the slide direction +S. The inner wall of the box body 160 on the slide direction −S side has a to-be-pressed surface 164 that faces the tip rear side of the lever 140.

In the box body 160, the to-be-pressed section 162 is pressed by the lever 140 while the lever 140 is rotating in the first rotation direction R1, and the to-be-pressed surface 164 is pressed by the lever 140 while the lever 140 is rotating in the second rotation direction R2. In other words, the lever 140 presses the to-be-pressed section 162 while the lever 140 is rotating in the first rotation direction R1, and the lever 140 presses the to-be-pressed surface 164 while the lever 140 is rotating in the second rotation direction R2.

As shown in FIG. 4, the pressing unit 110 rotates the transmission shaft 101 and the lever 140 with the driving force from the motor 102 in the first rotation direction R1 to place the rollers 152 at positions where the rollers 152 are able to press the medium M against the second support section 52. On the other hand, the pressing unit 110 rotates the transmission shaft 101 and the lever 140 with the driving force from the motor 102 in the second rotation direction R2 to place the rollers 152 at positions where the rollers 152 are unable to press the medium M.

In the description below, as indicated by the chain double-dashed line in FIG. 4, "first position P1" refers to a position where the rollers 152 are able to press the medium M against the support section 52, and "first angle A1" refers to an angle of the lever 140 at which the rollers 152 are placed at the first position P1. Furthermore, as indicated by solid lines in FIG. 4, "second position P2" refers to a position where the rollers 152 are unable to press the medium M, and "second angle A2" refers to an angle of the lever 140 at which the rollers 152 are placed at the second position P2. In this embodiment, the moving member 130 (rollers 152) moves (slides) between the first position P1 and the second position P2 with the driving force from the motor 102.

Furthermore, at the first position P1, the rollers 152 are able to come into contact with the medium M that is supported by the support section 50 (second support section 52), and at the second position P2, the rollers 152 are unable to come into contact with the medium M that is supported by the support section 50 (second support section 52).

Furthermore, the first position P1 is within the area between the carriage 42 and the support section 50, and the second position P2 is outside the area between the carriage 42 and the support section 50. Furthermore, the first position P1 is also within the area between the carriage 42 and the second support section 52.

Here, "the area between the carriage 42 and the support section 50" corresponds to an area defined between the carriage 42 and the support section 50 in their side cross-sectional view. FIG. 2 shows "the area between the carriage 42 and the support section 50" using a first boundary E1 and a second boundary E2. The first boundary E1 is defined by a virtual line that extends from an upstream end portion of the carriage 42 in the transport direction F toward the support section 50 along the direction (in this embodiment, the up-down direction Z) in which the carriage 42 faces the support section 50. The second boundary E2 is defined by a virtual line that extends from a downstream end portion of the carriage 42 in the transport direction F toward the support section 50 along the direction (in this embodiment, the up-down direction Z) in which the carriage 42 faces the support section 50.

It is assumed that the first boundary E1 and the second boundary E2 extend until the boundaries E1 and E2 reach the support section 50 if the support section 50 exists at the position where the support section 50 faces the end portions of the carriage 42, and extend to the height of the support surface of the support section 50 if the support section 50 does not exist at the position where the support section 50 faces the end portions of the carriage 42. It is assumed that the first boundary E1 and the second boundary E2 are defined to have widths large enough to cover the movement area of the carriage 42 in the width direction X. The area that exists between the first boundary E1 and the second boundary E2 corresponds to "the area between the carriage 42 and the support section 50". The carriage 42 is an example of a holding section that holds the discharge section 41, and consequently, "the area between the carriage 42 and the support section 50" may be referred to as "the area between the holding section and the support section 50".

In this embodiment, the second position P2 is located downstream of the first position P1 in the transportation direction F, and is away from the support section 50 compared with the first position P1 in the direction (up-down direction Z) in which the discharge section 41 faces the support section 50. In short, the liquid discharge apparatus includes the pressing section that can move to the first position P1 for pressing the medium M against the support section 50 or to the second position P2 for not pressing the medium M. The pressing section is positioned at the position within the area between the holding section and the support section 50 at the first position P1, and is positioned at the position outside the area between the holding section and the support section 50 at the second position P2. To press the medium M, the pressing section is placed in the first position P1 that is located within the area between the holding section and the support section 50 and thereby the medium M on which a liquid has been discharged can be pressed at the position near the discharge section 41. Furthermore, to release the medium M, the pressing section is placed in the second position P2 that is located outside the area between the holding section and the support section 50, and thereby the risk of the pressing section that is placed in the second position P2 coming into contact with the discharge section 41 and/or the holding member can be reduced.

In this embodiment, the pressing section slides between the first position P1 and the second position P2. With this structure, the movement area of the pressing section can be restricted to a relatively small area.

Furthermore, as shown in FIG. 4, the pressing section moves from the first position P1 to the second position P2 by moving in the diagonal direction with respect to the direction in which the support section 50 faces the discharge section 41. That is, the pressing section moves away from the support section 50 to move from the first position P1 to the second position P2. During the movement of the pressing section, if the pressing section is moved along the direction in which the support section 50 faces the discharge section 41, the pressing section that moves away from the support section 50 comes close to the discharge section 41 and the holding section, and may come into contact with the discharge section 41 and/or the holding section. As in this embodiment, the pressing section is moved in the diagonal direction with respect to the direction in which the support section 50 faces the discharge section 41 to move the pressing section from the first position P1 to the second position P2 and thereby the pressing section can be prevented from moving toward the discharge section 41 and the holding section when the pressing section is moved away from the support section 50. Consequently, the pressing section can be appropriately prevented from coming into contact with the discharge section 41 and/or the holding section when the pressing section is placed in the second position P2.

Furthermore, as described above, the pressing section presses the medium M against the second support section 52 at the first position P1. With this structure, the pressing section presses the medium M against the second support section 52 that is lower than the first support section 51 in height, and thereby the medium M can be further prevented from rising from the support section 50. Accordingly, the risk of the medium M supported by the support section 50 coming into contact with the discharge section 41 and the carriage 42 can be further reduced.

The controller 60 in the printing device 10 controls the components in the printing device 10 in accordance with a print job input into the printing device 10. For example, the controller 60 controls driving of the transport section 30 to perform a transport operation for transporting the medium M by a predetermined amount in the transport direction F, and controls driving of the print section 40 to discharge an ink from the discharge section 41 to perform printing of one pass while moving the carriage 42 in the width direction X. Furthermore, the controller 60 changes the states of the pressing mechanism 100, i.e., the arrangement of the rollers 152 of the pressing mechanism 100 depending on the type of medium M to be printed.

Typically, the printing device 10 according to the embodiment performs printing on various media. For example, the media M (paper) to be printed with the printing device 10 according to the embodiment include matte paper that has low glossiness and glossy paper that has high glossiness.

The matte paper includes, for example, a paper-based material, and a discharged ink can readily permeate into the base material. Accordingly, the matte paper may cause an undulating phenomenon (hereinafter, also referred to as "cockling") in the width direction X when the ink is discharged, and the paper may rise from the support section 50.

On the other hand, the glossy paper includes, for example, a resin-based material, and the discharged ink does not readily permeate into the base material. Accordingly, the glossy paper rarely causes cockling when the ink is discharged, and rising of the paper from the support section 50 can be suppressed.

Furthermore, the media M of the matte paper and the glossy paper have different surfaces (coat layers) of different materials respectively, and their abrasion resistances differ accordingly. That is, the matte paper (image) is resistant to creases caused by pressing the paper, on which the image has been printed, against the support section 50 by the rollers 152. On the other hand, the glossy paper (image) is less resistant to creases caused by pressing the paper, on which the image has been printed, against the support section 50 by the rollers 152.

In view of the above, to perform printing on the medium M such as the matte paper, which absorbs the ink well, tends to rise from the support section 50, and is resistant to creases caused by the pressure by the rollers 152, the controller 60 places the rollers 152 in the first position P1 to reduce rising of the medium M. On the other hand, to perform printing on the medium M such as the glossy paper, which absorbs less ink, rarely rises from the support section 50, and is less resistant to creases caused by the pressure by the rollers 152, the controller 60 places the rollers 152 in the second position P2 to reduce unnecessary contact of the medium M and the rollers 152.

Specifically, when a user inputs a job into the printing device 10 according to the embodiment, the user is required to enter the type of medium M to be printed. Based on the information of the medium M input by the user, the controller 60 in the printing device 10 determines whether to press the medium M with the rollers 152, and determines the placement of the rollers 152 in the pressing mechanism 100. In other words, the liquid discharge apparatus includes the controller 60 that determines whether to place the pressing section in the first position P1 or in the second position P2 depending on the type of medium M. For this operation, it is preferable that the controller 60 store in advance a map or a table that indicates whether the medium M is to be pressed with the rollers 152 depending on the type of medium M.

In this embodiment, the controller 60 determines whether to press the medium M with the rollers 152 depending on whether the type of medium M is matte paper or glossy paper. Alternatively, the controller 60 may determine whether to press the medium M with the rollers 152 based on the other information. For example, the controller 60 may determine whether to press the medium M with the rollers 152 based on the thickness of the medium M, the material (paper, a resin, a cloth, or the like) of the medium M, or the like.

Furthermore, it is assumed that "undulation cycle Pw" refers to a cycle in which the medium M undulates in the width directions X due to the ink discharged throughout the medium M (for example, matte paper) that tends to cockle, among the media M onto which printing can be performed by the printing device 10 according to the embodiment. In other words, the undulation cycle Pw corresponds to one cycle of a crest and a trough in the width directions X when the medium M cockles.

If it is assumed that the arrangement interval Dr of the rollers 152 in the width direction X is greater than or equal to the undulation cycle Pw, only the trough portions of the undulating medium M may be pressed. The trough portions in undulations are convex portions (concave portions with respect to the crests of the undulations) with respect to the support section 50, and even if the trough portions are pressed, it is difficult to reduce rising of the medium M. To solve the problem, in this embodiment, the arrangement interval Dr of the rollers 152 in the width direction X is determined to be a value less than the undulation cycle Pw so that the crest portions (convex portions with respect to the carriage 42, and convex portions with respect to the troughs of the undulations) of the undulating medium M can be pressed.

In other words, if a cycle of undulations of the medium M in the width direction X of the medium M caused by discharging a liquid onto the medium M is defined as a undulation cycle Pw, a plurality of rollers 152 are aligned in the width direction X, and the arrangement interval Dr between the rollers 152 is an interval shorter than the undulation cycle Pw. With this arrangement interval Dr, rising of the undulating medium M from the support section 50 can be effectively reduced.

According to an experiment for evaluating a relationship between the arrangement interval Dr of the rollers 152 in the width direction X and the amount of rising of the medium M with respect to the second support section 52, it is preferable that the arrangement interval Dr of the rollers 152 in the width direction X be less than or equal to one third of the undulation cycle Pw. With this arrangement interval Dr, the amount of rising of the medium M with respect to the second support section 52 can be reduced, and the medium M can be appropriately prevented from coming into contact with the carriage 42 and/or the discharge section 41.

Meanwhile, it is assumed that a minimum value of the arrangement interval Dr of the rollers 152 is an arrangement interval (=the thickness of the roller 152) of the rollers 152 that are adjoin to each other on their side surfaces. In such a case, if the arrangement interval Dr of the rollers 152 is the minimum value, the rollers 152 are aligned in a close contact manner in the width direction X.

The arrangement interval Dr of the rollers 152 is determined based on the undulation cycle Pw under the condition the ink is discharged throughout the medium M because the amount of water per unit area to be absorbed by the medium M has the maximum amount under the condition. That is, under the condition, the medium M cockles with a highest undulating height (amplitude) and with a shortest undulation cycle Pw.

When the medium M cockles, the medium M rises in a mountain shape on the support section 50 viewed from the width direction X. The mountain-shaped rising of the medium M tends to occur on the second support section 52 that does not suck the medium M whereas the rising of the medium M rarely occur on the first support section 51 that can suck the medium M. Consequently, if the medium M can be sucked on the second support section 52, the rising of the medium M can be suppressed on the second support section 52, however, in such a case, the transport resistance increases and prevents smooth transport of the medium M by the transport section 30.

According to the embodiment, the medium M is pressed by the rollers 152 against the second support section 52, and this achieves appropriate pressing of the medium M in the locations the medium M tends to rise.

Now, with reference to FIG. 3 to FIG. 6, the operation of the printing device 10 according to the embodiment will be described. As shown in FIG. 3 and FIG. 4, to perform printing on the medium M (for example, glossy paper) that rarely causes cockling in the printing device 10 according to the embodiment, the rollers 152 of the pressing mechanism 100 are placed in the second position P2. That is, as shown in FIG. 4, the motor 102 is driven to rotate the transmission shaft 101 and the lever 140 that is connected to the transmission shaft 101 in the second rotation direction R2. Then, the lever 140 presses the to-be-pressed surface 164 of the box body 160 to apply the force in the slide direction −S with respect to the moving member 130.

By the application of the force, the rail 153 slides together with the convex portion 123 provided in the bent portion 122 of the support frame 120 through the slide groove 154 and the moving member 130 changes its position in the slide direction −S. Then, the rotational angle of the lever 140 becomes the second angle A2, and the rollers 152 of the pressing mechanism 100 are placed in the second position P2. In other words, the rollers 152 are placed outside the area between the reciprocation area of the carriage 42 and the second support section 52 in the width direction X.

After the rollers 152 are placed in the second position P2, the medium M that has been fed from the sheet feeding section 20 is transported onto the support section 50 by the transport section 30. The medium M that is transported by the transport section 30 is transported on the first support section 51, and then transported on the second support section 52 that is lower than the first support section 51.

With this structure, the medium M that curls around the roll body R, that is, the medium M that curves in a convex shape toward the discharge section 41 on the support section 50 is transported onto the support section 50, as indicated by the alternate long and short dashed lines in FIG. 4, and the medium M drops onto the second support section 52 when the tip of the medium M arrives the second support section 52. Accordingly, rising of the medium M from the support section 50 can be reduced by the amount of the drop of the medium M onto the second support section 52 at the start of the transport of the medium M.

The medium M is transported to the position where printing can be performed, and then, the discharge section 41 and the transport section 30 alternately perform the print operation and the transportation operation to perform printing on the medium M that is sucked by the first support section 51. Since the rollers 152 are placed in the second position P2, the rollers 152 can be prevented from coming into contact with the printed medium M, and thereby the medium M (glossy paper) can be prevented from being creased on its surface by the rollers 152.

Furthermore, the rollers 152 placed in the second position P2 are placed downstream of the reciprocation movement area of the carriage 42 in the width direction X in the transport direction F, and thereby the rollers 152 can be prevented from coming into contact with the carriage 42 that reciprocates in the width directions for the printing operation.

Figure 5:
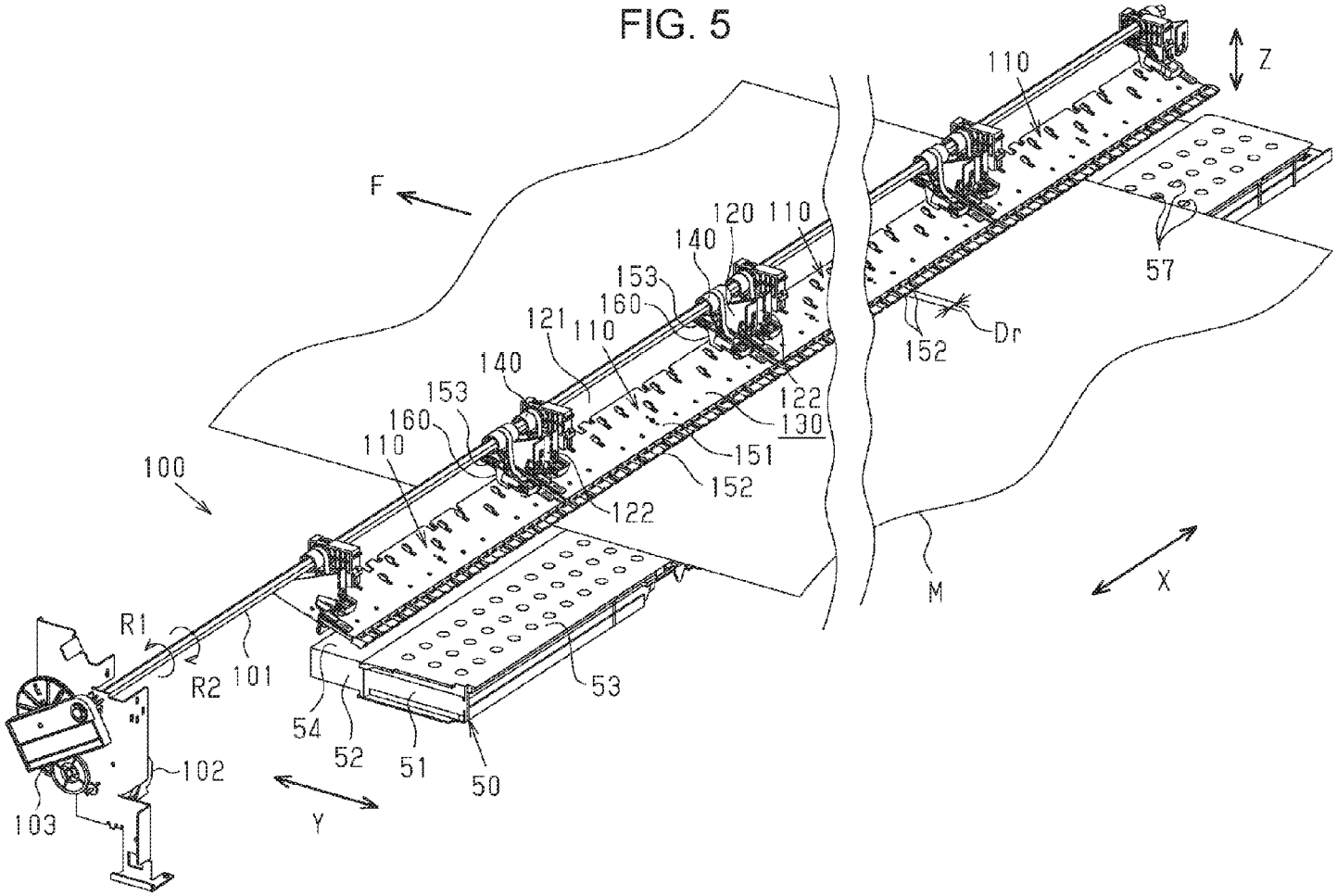
FIG. 5 is a perspective view of the pressing mechanism in which the rollers are placed in the first position.
Figure 6:
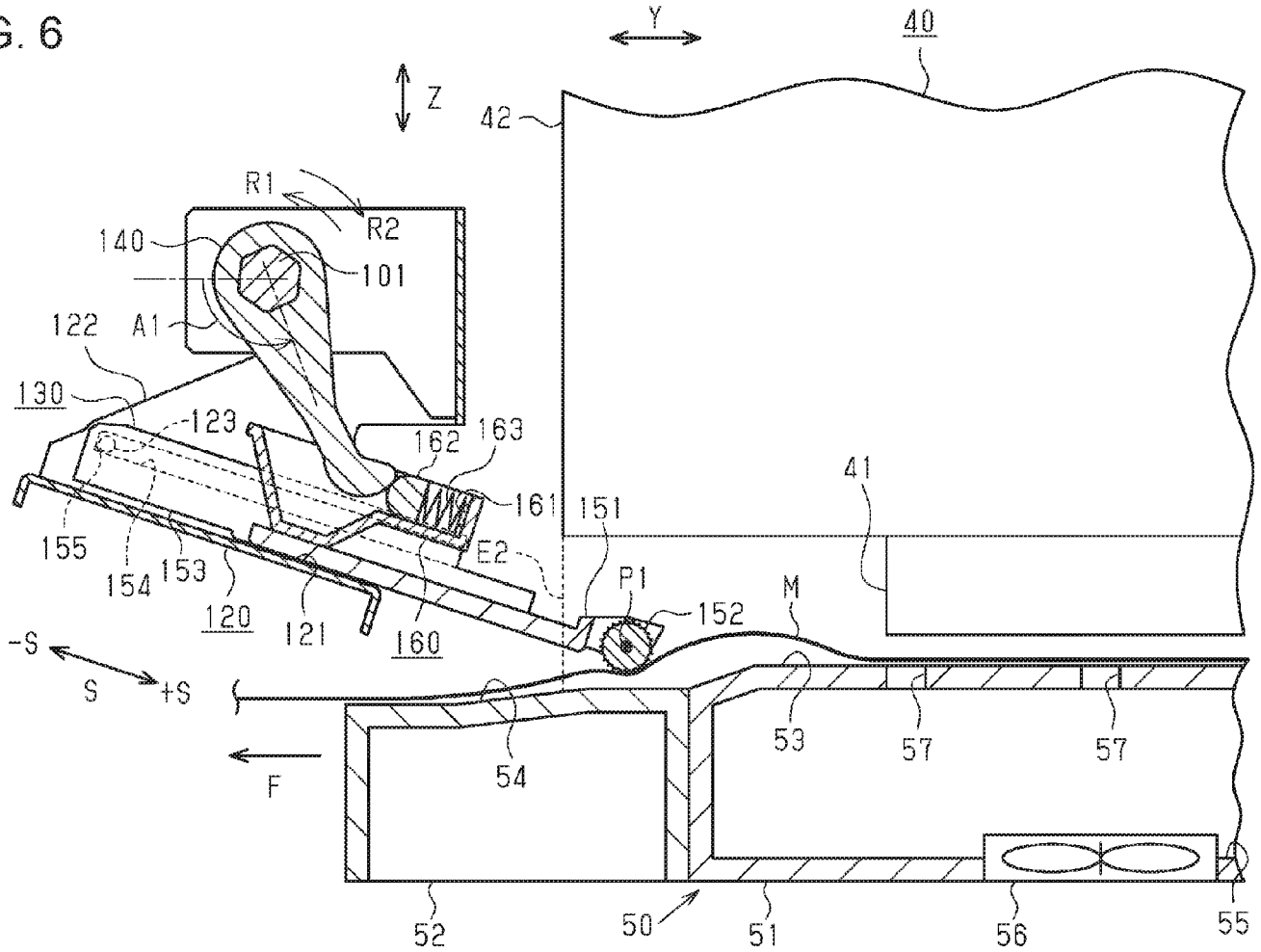
FIG. 6 is a side cross-sectional view of the pressing unit when the rollers are placed in the first position.

As shown in FIG. 5 and FIG. 6, to perform printing on the medium M (for example, matte paper) that rarely causes cockling in the printing device 10 according to the embodiment, the rollers 152 of the pressing mechanism 100 are placed in the first position P1. In other words, as shown in FIG. 6, the motor 102 is driven to rotate the transmission shaft 101 and the lever 140 that is connected to the transmission shaft 101 in the first rotation direction R1. Then, the lever 140 presses the to-be-pressed section 162 in the box body 160 to slightly compress the coil spring 163 and apply the force in the slide direction +S with respect to the moving member 130.

By the application of the force, the rail 153 slides together with the convex portion 123 provided in the bent portion 122 of the support frame 120 through the slide groove 154 and the moving member 130 changes its position in the slide direction +S. Then, the rotational angle of the lever 140 becomes the first angle A1, and the restriction surface 155 of the slide groove 154 of the rail 153 comes into contact with the convex portion 123 of the support frame 120, and thereby movement of the moving member 130 in the slide direction +S can be restricted.

By the above-described operation, the rollers 152 of the pressing mechanism 100 are placed in the first position P1. In other words, the rollers 152 are placed inside the area between the reciprocation movement area of the carriage 42 and the second support section 52 in the width direction X.

The medium M is transported to the position where printing can be performed, and then, the discharge section 41 and the transport section 30 alternately perform the print operation and the transportation operation to perform printing on the medium M that is sucked by the first support section 51. Due to the ink discharge, the medium M cockles and rises from the second support section 52 that does not suck the medium M, however, the medium M can be pressed by the rollers 152 that are placed in the first position P1. Accordingly, rising of the medium M from the second support section 52 can be prevented.

Furthermore, since the rollers 152 that are placed in the first position P1 prevents the medium M from rising in the position near the discharge section 41 in the transport direction F, rising of the medium M from the downstream portion of the first support section 51 in the transport direction F can also be prevented. Consequently, the printed medium M can be prevented from coming into contact with the carriage 42 that reciprocates in the width directions X and the discharge section 41 that is supported by the carriage 42.

Meanwhile, as shown in FIG. 6, in this embodiment, when the lever 140 is further rotated in the rotation direction R1 from the state the restriction surface 155 of the slide groove 154 of the rail 153 comes into contact with the convex portion 123 of the support frame 120, only the coil spring 163 is compressed, and the moving member 130 is not moved in the slide direction +S. In other words, to place the rollers 152 in the first position P1, the rotational angle of the lever 140 (transmission shaft 101) is to be increased to an angle greater than or equal to the first angle A1.

On the other hand, if the rotational angle of the lever 140, which can place the rollers 152 in the first position P1, is limited only to the first angle A1 (if the coil spring 163 is not provided), the following problem may arise due to variations in the first angles A1 of the levers 140 in individual pressing units 110 caused by the accuracy of the components or the accuracy of assembly. That is, to place the rollers 152 of the pressing unit 110 to the first position P1, the transmission shaft 101 is rotated, however, the rollers 152 of the other pressing units 110 may not be placed to the first position P1.

To solve the problem, according to the embodiment, the transmission shaft 101 is rotated in the first rotation direction R1 such that the rotational angles of the levers 140 of all pressing units 110 exceed the first angle A1, and thereby the rollers 152 of all pressing units 110 can be placed at the first position P1. That is, if there are variations in the first angles A1 that enable the rollers 152 of the pressing units 110 to be placed in the first position P1, the variations can be reduced by the compression deformation of the coil springs 163.

A method of pressing a medium according to the embodiment is summarized as follows. There is provided a method of pressing a medium in a liquid discharge apparatus including the support section 50 that supports the medium M, the discharge section 41 configured to discharge a liquid onto the medium M that is supported by the support section 50, the holding section that holds the discharge section 41, and the pressing section capable of pressing the medium M against the support section 50. The method includes placing the pressing section in the first position P1 within the area between the holding section and the support section 50 to press the medium M, and placing the pressing section in the second position P2 outside the area between the holding section and the support section 50 to release the medium M. According to the method of pressing a medium, to press the medium M, the pressing section is placed in the first position P1 within the area between the holding section and the support section 50 and thereby the medium M on which the liquid has been discharged can be pressed at the position near the discharge section 41. Furthermore, to release the medium M, the pressing section is placed in the second position P2 that is outside the area between the holding section and the support section 50, and thereby the risk of the pressing section that is placed in the second position P2 coming into contact with the discharge section 41 and/or the holding member can be reduced.

According to the embodiment, the following advantages can be achieved.

1. The rollers 152 are placed in the first position P1 to reduce rising of the medium M, on which an ink has been discharged, from the support section 50, for example, to print on matte paper. The rollers 152 are placed in the second position P2 if there is no need to reduce rising of the medium M, on which an ink has been discharged, from the support section 50, for example, to print on glossy paper.

Since the first position P1 is provided within the area between the carriage 42 and the support section 50, the rollers 152 that are placed in the first position P1 can press the medium M on which the liquid has been discharged at the position near the discharge section 41. This operation reduces rising of the medium M from the support section 50. Furthermore, since the second position P2 is provided outside the area between the carriage 42 and the support section 50, the risk that the rollers 152 that are placed in the second position P2 and the sliders 151 that support the rollers at their tips come into contact with the discharge section 41 and/or the carriage 42 can be reduced.

2. In a case where the structure in which the rollers 152 move between the first position P1 and the second position P2 is employed, it is preferable not to provide a member for regulating the movement of the rollers 152 between the first position P1 and the second position P2. According to this embodiment, the rollers 152 slides between the first position P1 and the second position P2, and the area in which the rollers 152 move can be reduced compared with, for example, a case where the rollers 152 rotate and move between the first position P1 and the second position P2. With this structure, the degree of freedom of arrangement of the other components in areas other than the movement area of the rollers 152 can be increased.

3. The rollers 152 move downstream in the transport direction F to increasingly move away from the support section 50 when the rollers 152 move from the first position P1 to the second position P2. Accordingly, during the movement of the rollers 152 from the first position P1 to the second position P2, the rollers 152 can be moved away from the medium M compared with a case where the rollers 152 are simply moved downstream in the transport direction F. With this structure, unnecessary contact between the rollers 152 that are placed in the second position P2 and the medium M can be reduced.

4. The controller 60 places the rollers 152 in the first position P1 to perform printing on the medium M that tends to rise from the support section 50 due to ink discharge, and places the rollers 152 in the second position P2 to perform printing on the medium M that rarely rises from the support section 50 when the ink is discharged. In other words, the positioning of the rollers 152 can be appropriately switched depending on the type of medium M.

5. The second support section 52 is lower than the first support section 51 in the up-down direction Z. With this structure, at the start of transport of the medium M that curves outward from the support section 50 toward the discharge section 41, the tip portion of the medium M drops onto the second support section 52, and thereby rising of the medium M on the support section 50 can be reduced. Accordingly, at the start of transportation of the medium M, the risk of the medium M coming into contact with the discharge section 41 and/or the carriage 42 can be reduced.

6. The medium M is pressed against the second support section 52 that is lower than the first support section 51 by the rollers 152 that are placed in the first position P1. With this structure, rising of the medium M from the support section 50 can be further reduced compared with the case where the second support section 52 has the same height as the first support section 51. Accordingly, the risk of the medium M supported by the support section 50 coming into contact with the discharge section 41 and/or the carriage 42 can be further reduced.

7. If a structure in which the rollers 152 do not rotate when the rollers 152 come into contact with the transported medium M is employed, for example, if the rollers 152 are a pressing plate having a plate-like shape, the medium M may be creased due to the friction between the roller 152 and the medium M on which the ink has been discharged. According to the above-described embodiment, the medium M is pressed by the rollers 152 that rotate by coming into contact with the transported medium M, and this causes less friction between the rollers 152 and the medium M, and thereby the occurrence of the above problem can be reduced.

8. The arrangement interval Dr of the rollers 152 is less than the undulation cycle Pw, and thereby the crest portions (convex portions with respect to the discharge section 41) of the undulating medium M can be readily pressed. With this arrangement intervals, rising of the cockling (undulating) medium M from the support section 50 can be effectively reduced.

9. The movement area of the moving member 130 in the slide direction S does not overlap the movement area of the carriage 42 in the width direction X, and accordingly, if the position of the moving member 130 is changed in a state the carriage 42 faces the support section 50, the moving member 130 and the carriage 42 can be prevented from coming into contact with each other. In other words, the moving member 130 and the carriage 42 can be prevented from coming into contact with each other.

10. The pressing mechanism 100 includes a plurality of pressing units 110 that are aligned in the width direction X. Accordingly, for example, to manufacture a printing device 10 that uses the support section 50 that has a different length in the width direction X, the number of the pressing units 110 aligned in the width direction X is to be simply changed. In other words, according to the pressing mechanism 100 according to the embodiment, the length of the pressing mechanism 100 in the width direction X can be readily changed depending on the length of the support section 50.

The above-described embodiment can be modified as follows.

In the above-described embodiment, the moving member 130 slides to place the rollers 152 in the first position P1 or the second position P2, however, the movement mechanism is not limited to this example. Alternatively, for example, the moving member 130 may rotate and move about the width direction as the rotational axis to place the rollers 152 in the first position P1 or the second position P2. In such a case, it is preferable that the moving member 130 be rotated and moved while the carriage 42 is placed in a position (home position) where the carriage 42 does not face the support section 50.

The second position P2 may not be provided downstream of the movement area of the carriage 42 in the width direction X in the transport direction F as long as the second position P2 is provided at a position outside the area between the movement area of the carriage 42 in the width direction X and the second support section 52. For example, the second position P2 may be provided above the movement area of the carriage 42 in the width direction X.

The height of the second position P2 may be the same height as the first position P1 in the direction (up-down direction Z) in which the discharge section 41 faces the support section 50. In other words, the positions of the rollers 152 may be changed only in the transport direction F without changing the positions in the up-down direction Z during the positional change of the rollers 152 between the first position P1 and the second position P2.

The suction holes 57 may be provided on the second support surface 54 of the second support section 52. With this structure, rising of the medium M from the second support section 52 can be further reduced.

The suction holes 57 may not be provided on the first support surface 53 of the first support section 51. That is, the medium M may not be sucked by the first support surface 53. In such a case, while the medium M is not sucked, rising of the medium M from the support section 50 can be reduced by the pressing mechanism 100.

The distance between the discharge section 41 and the second support section 52 may be the same as the distance between the discharge section 41 and the first support section 51, or may be less than the distance between the discharge section 41 and the first support section 51 in the direction (up-down direction Z) in which the discharge section 41 faces the support section 50.

The controller 60 may change the positioning of the rollers 152 according to an operation from a user of the printing device 10.

The controller 60 of the printing device 10 may change the positioning of the rollers 152 of the pressing mechanism 100 based on the content of a print job. For example, the controller 60 may place the rollers 152 of the pressing mechanism 100 in the first position P1 if the amount of discharged ink per unit area of the medium M is greater than or equal to a predetermined value. Furthermore, the controller 60 may place the rollers 152 of the pressing mechanism 100 in the second position P2 if the amount of discharged ink per unit area of the medium M is less than the predetermined value. It is preferable to obtain in advance the predetermined value through an experiment, and the like. Specifically, the amount of ink discharged in a unit area of the medium M is gradually increased, and when pressing of the medium M with the rollers 152 is required, it can be determined that the amount of ink at that time corresponds to the predetermined value.

The rollers 152 may be any rollers other than the star wheel rollers. For example, the rollers 152 may be cylindrical rollers that use the width direction X as the axis direction. Alternatively, the rollers 152 may be a single roller that has the same length as the support section 50 in the width direction X.

The pressing mechanism 100 may not include the rollers 152. In such a case, the medium M comes into contact with the tip portion of the slider 151 and thereby rising of the medium M from the second support section 52 can be reduced. In such a case, the tip portion of the slider 151 corresponds to an example of the "pressing section".

The arrangement interval Dr of the rollers 152 in the width direction X may be the same distance as the undulation cycle Pw or may be a distance wider than the undulation cycle Pw.

The arrangement interval Dr of the rollers 152 in the width direction X may be a distance irrelevant to the characteristic (the undulation cycle Pw on the condition that the ink is discharged throughout the medium M) of the medium M. The arrangement interval Dr may be a regular interval or an irregular interval.

A portion of the rollers 152 may extend beyond the area between the carriage 42 and the second support section 52 as long as the rotation center of the rollers 152 is within the area between the carriage 42 and the second support section 52 when the rollers 152 of the pressing mechanism 100 are placed in the first position P1. A portion of the rollers 152 may extend within the area between the carriage 42 and the second support section 52 as long as the rotation center of the rollers 152 is outside the area between the carriage 42 and the second support section 52 when the rollers 152 are placed in the second position P2.

The printing device 10 may be a so-called line type printing device in which the print section 40 includes, instead of the carriage 42, a long fixed print head that has a length corresponding to the whole width of the medium M. In such a case, the print head may include a plurality of unit heads having nozzles respectively, the unit heads being aligned in parallel to cover the print region of the width of the medium M, or may be a single long head that includes many nozzles to cover the print region of the width of the medium M. With such print heads, the pressing mechanism 100 according to the embodiment can prevent the rollers 152 from coming into contact with the unit heads, the long head, and the holding section for holding the heads when the rollers 152 are placed in the second position P2.

The recording material to be used for printing may be a fluid (for example, liquids, liquid materials containing particles of a functional material dispersed or mixed in a liquid, fluid materials such as gels, and solids that can be discharged as fluids) other than inks. For example, a liquid material containing a dispersed or dissolved material such as an electrode material or a color material (pixel material) used for manufacturing liquid crystal displays, electroluminescence (EL) displays, or field emission displays (FEDs) may be discharged for recording.

The printing device 10 may be a fluid material discharge apparatus that discharges a fluid material such as a gel (for example, a physical gel), or a powder and granular material discharge apparatus (for example, a toner jet type recording apparatus) that discharge a solid, for example a powder (powder and granular material) such as a toner. In this specification, "fluid" implies a concept that does not include fluids that consist of only gas, and the fluid includes, for example, liquids (including inorganic solvents, organic solvents, solutions, liquid resins, liquid metals (metallic melts), and the like), liquid materials, fluid materials, and powder and granular materials (including grains and powders).

This application claims priority under 35 U.S.C. §119 to Japanese Patent Application No. 2015-176006, filed Sep. 7, 2015. The entire disclosure of Japanese Patent Application No. 2015-176006 is hereby incorporated herein by reference.

What is claimed is:

1. A liquid discharge apparatus comprising:

a support section that supports a medium;

a discharge section configured to discharge a liquid onto the medium that is supported by the support section;

a holding section that holds the discharge section; and a pressing section capable of changing its position to a first position for pressing the medium against the support section or to a second position for releasing the medium, wherein the pressing section is placed within an area between the holding section and the support section at the first position, and is placed outside the area between the holding section and the support section at the second position, wherein a length of the area between the holding section and the support section in a front-rear direction is defined to correspond to a length of the holding section in the front-rear direction.

2. The liquid discharge apparatus according to claim 1, wherein the pressing section slides between the first position and the second position.

3. The liquid discharge apparatus according to claim 1, wherein the pressing section moves from the first position to the second position by moving in a diagonal direction with respect to a direction in which the support section faces the discharge section.

4. The liquid discharge apparatus according to claim 1, further comprising:

a controller configured to determine whether to place the pressing section in the first position or in the second position depending on the type of medium.

5. The liquid discharge apparatus according to claim 1, wherein the support section includes a first support section for supporting the medium within a region the discharge section discharges the liquid, and a second support section for supporting the medium outside the discharge region, wherein a space between the second support section and the discharge section is wider than a space between the first support section and the discharge section in the direction in which the support section faces the discharge section.

6. The liquid discharge apparatus according to claim 5, wherein the pressing section presses the medium against the second support section in the first position.

7. The liquid discharge apparatus according to claim 1, wherein the pressing unit is a rotatable roller.

8. The liquid discharge apparatus according to claim 7, wherein if a cycle in which the medium undulates in a width direction of the medium due to the discharge of the liquid onto the medium is an undulation cycle, a plurality of rollers are aligned in the width direction, and an arrangement interval between the rollers is shorter than the undulation cycle.

* * * * *